United States Patent [19]

Penato et al.

[11] Patent Number: 4,799,250

[45] Date of Patent: Jan. 17, 1989

[54] ROTATING ANODE WITH GRAPHITE FOR X-RAY TUBE

[75] Inventors: Jean M. Penato, Les Essarts le Roi; Emile Gabbay, Paris; Yves Debrouwer, Charenton, all of France

[73] Assignee: Thomson-CGR, Paris, France

[21] Appl. No.: 3,142

[22] Filed: Jan. 14, 1987

[30] Foreign Application Priority Data

Jan. 17, 1986 [FR] France ..... 86 00654

[51] Int. Cl.[4] ..... H01J 35/10

[52] U.S. Cl. ..... 378/144; 378/125; 378/143

[58] Field of Search ..... 378/143, 144, 125, 127; 420/422

[56] References Cited

U.S. PATENT DOCUMENTS 3,329,847 7/1967 Friedman .
3,890,521 6/1975 Shroff .
3,998,632 12/1976 Kosteruk et al. ..... 420/422
4,352,041 9/1982 Hübner et al. .
4,637,042 1/1987 Braun ..... 378/143

FOREIGN PATENT DOCUMENTS 0023065 1/1981 European Pat. Off. .
0037956 10/1981 European Pat. Off. .
1575111 7/1969 France .

*Primary Examiner*—Carolyn E. Fields
*Assistant Examiner*—David P. Porta
*Attorney, Agent, or Firm*—Oblon, Fisher, Spivak, McClelland & Maier

[57] ABSTRACT

The invention pertains to a rotating anode with graphite for an X-ray tube in which the quality of the bond with the graphite is considerably improved in comparison with the prior art, through the use of a bonder element comprising beryllium.

5 Claims, 2 Drawing Sheets

ROTATING ANODE WITH GRAPHITE FOR X-RAY TUBE

BACKGROUND OF THE INVENTION

1. Field of the Invention

The present invention pertains to a rotating anode for X-ray tubes, an anode of a composite type with graphite.

The X-radiation produced by an X-ray tube results from the bombardment, by a cathode-generated beam of electrons, of a refractory material with a high atomic number borne by the anode. These materials which possess a high atomic number comprise, for example, tungsten, tantalum and, also, molybdenum: these materials are called "target materials" in the rest of the description.

The emission of X photons is accompanied by a high emission of heat: the energy yield of the X rays produced, i.e. the ratio of the energy of the X photons to the energy of the impinging electrons is about 1% and the rest is transformed into heat.

In general, it is only by radiation that the heat accumulated in the anode is discharged. Hence anodes, and especially rotating anodes, are most often built so as to favour heat radiation and, to this effect, they comprise one or more graphite elements.

The essential function of the graphite is to increase the thermal radiation. The increase in thermal radiation $\Delta W$ can be written:

$$\frac{\Delta W}{W} = \frac{\Delta \epsilon}{\epsilon}$$

where W is the energy and $\epsilon$ is the coefficient of radiation or the coefficient of emissivity. The gain in dissipated energy varies linearly with the coefficient of emissivity, moreover when all conditions are equal.

Besides, the energy radiated W is proportionate to the temperature to the power of 4, expressed in °K. Thus, for a radiated energy W1 corresponding to a temperature T1=1250° C., and a second radiated energy W2 corresponding to a second temperature T2=1000° C., the ratio $$\frac{W1}{W2} = 2.$$

This shows how important it is to be able to carry the anode disk to the highest possible temperature so as to derive the maximum advantage that can be given by the thermal radiation due to graphite.

The contribution of graphite in the rotating anode disks can be provided in different ways. As a general rule, the anode disk is a composite disk formed of a basic body, one surface of which at least partially lined with a target material.

The basic body may be directly made of graphite. The target material, tungsten for example, can be applied to the graphite either by brazing processes or, for example, as a layer deposited on the graphite through a depositing process by gaseous-phase depositing or, again, by electrolysis in the dry way. In any case, the quality of the bond between the tungsten and the graphite is of prime importance, on the one hand to obtain adequate adhesion of the tungsten to the graphite and, on the other hand, to establish a minimum thermal resistance between the tungsten or other target material considered to be the source of the heat, and the graphite which is provided to discharge the heat by radiation.

This bond between the tungsten or other target material and the graphite is made by a layer of bonding element: in the case of brazing, it is the brazing element which constitutes this bonding element and, in the case of gaseous-phase depositing or electrolysis in the dry way, this bonding element is made up of a so-called intermediate element, deposited as a film between the target material and the graphite: this intermediate element is generally made of rhenium, which itself is a refractory material.

In other cases, the basic body is made, for example, of molybdenum to which the target material, such as tungsten, is applied according to a mechanical process for example: a graphite element is brazed to the basic body made of molybdenum, to a surface opposite to that of the target material. The quality of the bond between the molybdenum and the graphite is as important as in the previous examples, the bonding element being made of a relatively refractory material such as, for example, zirconium, titanium, palladium, rhodium etc.

Whatever the composition of these composite-type rotating anodes, it is frequently observed that the differences in temperature between the target material and the graphite element are greater than expected and that, consequently, the quantity of energy radiated is considerable less than hoped for.

The author of the present invention believes that this defect is due to the unsatisfactory quality of the graphite-tungsten or graphite-molybdenum bond and that, especially as regards the brazing processes, the brazing elements referred to above inadequately wet the graphite as well as the tungsten or molybdenum.

Furthermore, it must also be observed that if the brazing element has an excessively low melting point or an excessively high vapour point, these factors can lead to a reduction in the working temperature of the entire anode disk and can thus result in a diminishing of the quantity of energy radiated.

SUMMARY OF THE INVENTION

The present invention pertains to a rotating anode of the composite type, comprising graphite designed especially to increase the quantity of energy radiated, a rotating anode wherein the quality of the bond between the graphite and the elements to which it is joined is considerably improved as compared with the prior art so as to raise the limits of the working temperaure of the anode disk.

The composite-type rotating anode according to the invention comprises, around an axis of symmetry, a first part which is joined to a second part made of graphite, the first part comprising a target material designed to produce X radiation, wherein the first part and the second part are joined together by a bonding element comprising beryllium.

BRIEF DESCRIPTION OF THE DRAWINGS

The invention will be better understood from the following description which is given as a non-exhaustive example, and the appended drawings, of which.

DETAILED DESCRIPTION OF THE INVENTION

Figure 1:
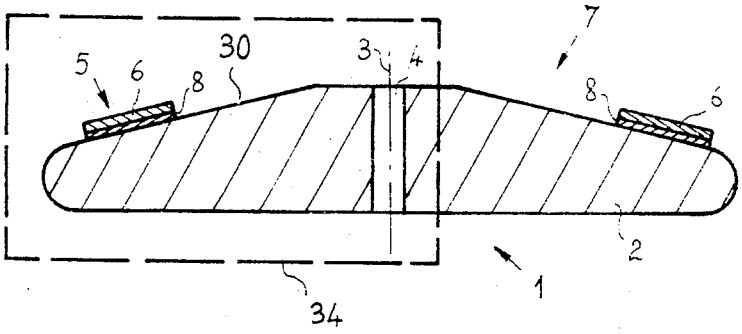
FIG. 1 is a schematic cross-section view of a rotating anode according to the invention comprising a graphite body on which a layer of a target material is deposited.

FIG. 1 depicts a rotating anode 1 according to the invention, comprising, in the non-exhaustive example described, a basic body 2 made up of a mass of graphite with an axis of symmetry 3. The basic body 2 has a hole 4 set along the axis of symmetry 3, designed to fix the rotating anode 1 to its support (which is not depicted in the figure).

In the non-exhaustive example of the description, a layer 6 of a target material made, for example, of tungsten or a tungsten compound, is deposited on a first surface 7 of the basic body 2. In the non-exhaustive example described, the layer 6 of the target material is deposited on a sloped part 30 of the surface 7, in the shape of a ring centered on the axis of symmetry 3 and designed, in the functioning of the anode, to constitute a focal ring. The layer 6 of the target material is deposited according to a conventional method, such as chemical depositing or gaseous-phase depositing for example, on a second layer 8 of a bonding element. The bonding element comprises, in part, in intermediate element, a conventional feature in this configuration, designed notably to give the tungsten or other target material adequate adhesion to the graphite of the basic body, and to prevent the carburizing of the tungsten or other target material. This intermediate material may be rhenium, for example.

According to one characteristic of the invention, the second layer 8 formed by the bonding element, is made up of the intermediate element described above, to which beryllium has been added. Beryllium constitutes a wetting agent which, even in small quantities, improves the tungsten-graphite bond; the proportion of beryllium, in relation to the intermediate element, is not of critical importance as will be seen in the rest of the description, and the second layer 8 can be formed by the intermediate element to which beryllium is added in a proportion of 10% by weight for example.

In the non-exhaustive example described, the first layer 6, made of tungsten, comprises a first part, joined to a second part formed by the graphite which constitutes the basic body 2, through the second layer 8 made up of the bonding element. In the functioning of the rotating anode 1, the layer 6 of target material constitutes the heat source, and the quality of the tungsten-graphite bond which is provided by the layer 8 of bonding element according to the invention, is used to discharge this heat in an optimum way through the radiation of the graphite.

The second layer 8 can be deposited as a bonding element according to one of the conventional methods, such as electrolysis for example, used to make a preliminary deposit of an intermediate layer of rhenium.

It is useful, especially after the first layer 6 of tungsten or other target material has been deposited, to heat the rotating anode 1 to a high temperature under a vacuum, . this high temperature being greaer than the working temperature of the anode 1. With this process, either the beryllium can be melted and diffused in the graphite as well as in the tungsten if the beryllium has been added in a small proportion, or a solid diffusion of beryllium in tungsten and graphite will be favoured if the beryllium has been added in a more substantial proportion, for example more than 10% by weight. This means that the excess beryllium can be discharged by evaporation.

Figure 2:
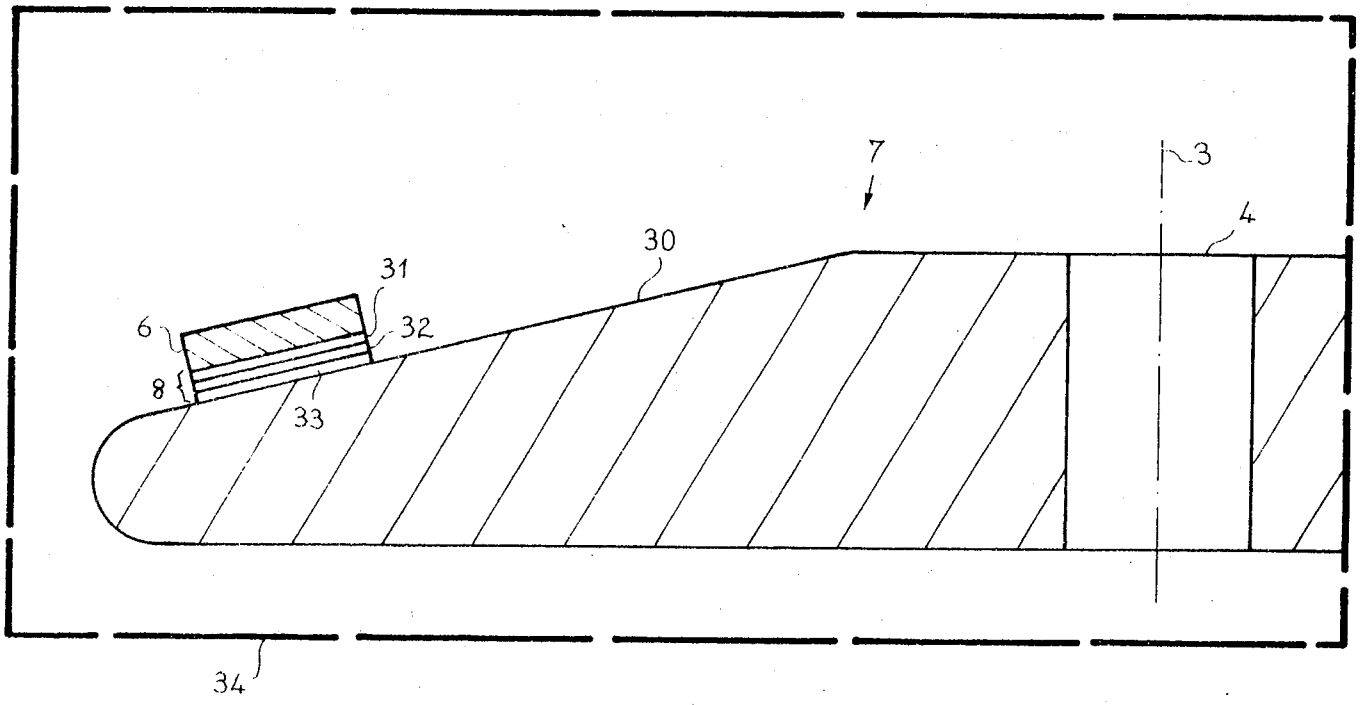
FIG. 2 depicts a part of the rotating anode of the invention depicted in a box in FIG. 1.

FIG. 2 illustrates another possibility of depositing the second layer 8, by depicting a part of the anode 1 represented in a box 34 in FIG. 1.

According to this other possibility, the second layer 8 made of a bonding element comprises a layer called an intermediate layer 32, formed either of pure rhenium or of rhenium mixed with pure beryllium, in contact either with the first layer of target material or with the graphite of the basic body 2.

In the non-exhaustive example described, the second bonding element layer 8 comprises a top layer 31 and a bottom pure beryllium layer 33 with the intermediate layer 32 between the top and bottom layers 31, 33: these top, bottom and intermediate layers, 31, 33 and 32 respectively, can be deposited by an electrolytic process for example.

In this configuration, the method consists in:

1. Depositing the bottom layer 33 of pure beryllium on the graphite of the basic body;

2. Then, in depositing the intermediate layer 32 of pure rhenium or rhenium mixed with beryllium on the bottom layer 33 which is already deposited on the graphite;

3. Then, in depositing the top layer 31 of pure beryllium on the intermediate layer 32 of pure or mixed rhenium.

4. And, finally, in depositing the first layer 6 of target material, tungsten for example, on the second layer 8 of bonding element, i.e. directly on the top of the layer 31 of pure beryllium using, for example, a gaseous-phase chemical depositing process as mentioned above.

It is then necessary to take the anode 1, under vacuum, to a temperature which is greater than the working temperature of the anode 1. The high temperature leads to the melting of the pure beryllium which, on the one hand, is diffused in the grain of the tungsten and, on the other hand, fills the graphite pores while, at the same time uniting with the layer formed of rhenium which may or may not be combined with beryllium. As in the previous case, the excess beryllium is discharged by evaporation under vacuum.

Figure 3:
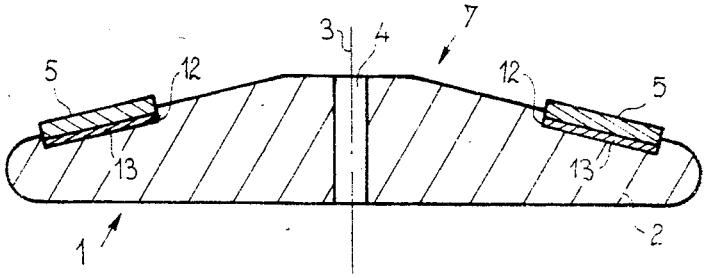
FIG. 3 depicts the anode of the invention according to a preferred embodiment, comprising a graphite body to which a target material is brazed.

FIG. 3 illustrates a preferred embodiment of the invention wherein the rotating anode 1 also comprises a basic body 2 made of graphite, but one in which the target material comprises a ring 5 joined to the basic body 2 by a brazing process. The ring 5 may, conventionally, comprise a target material which is a pure solid material or an alloy, for example solid tungsten or an alloy of tungsten or, again, a tungsten-molybdenum compound such as one that has tungsten (possibly alloyed) on the surface and a molybdenum support (not depicted) as an under-layer.

In the non-exhaustive example described, the surface 7 of the basic body 2 comprises a ring-shaped groove 12 centered on the axis of symmetry 3. The ring 5 of target material is applied to the graphite basic body 2 in the groove 12, wherein a third layer 13 of a bonding element has been previously deposited in a conventional way. In this case, the bonding element comprises a brazing element such as one previously described, for example titanium or zirconium to which a relatively small quantity of beryllium is added; the brazing is done by means (not depicted) which are known per se, used especially to heat the rotating anode 1 while a force is exerted in a conventional way on the ring 5 of the target material in order to press it against the basic body 2. The proportion of beryllium is not of critical importance, whether it is added to the rhenium as in the preceding examples or whether it is added to a brazing element. Tests have shown that the quality of the tungsten-graphite bonding is improved, with a beryllium proportion of even 1% by weight, and it has not been thought to be necessary, in practice, to go beyond 15%, the excess beryllium being discharged by evaporation under vacuum.

We believe that the brazing materials used, such as zirconium or titanium do not properly wet the graphite and the target material (tungsten or molybdenum, for example). Beryllium is a wetting agent which is diffused extensively in tungsten or molybdenum and in graphite, creating alloys for which it is possible to displace the equilibriums by high-temperature vacuum heating and to vaporize the excess of material.

The role of beryllium, although this element has a low melting point and a high vapour pressure, can be explained as follows: after being alloyed with titanium or zirconium for example, the alloyed beryllium, on the one hand fills up the pores in the graphite in particular and, on the other hand, is diffused through the grain of the tungsten or molybdenum and is alloyed with the tungsten in any proportion, thus providing for a good quality tungsten-beryllium bond. In bringing the entire piece to high temperature under vacuum, for example to a temperature of 1550° C. which is above the desired working temperature of the anode 1, the excess beryllium is removed by evaporation under vacuum. The remainder, being enclosed within the tungsten or molybdenum and the graphite, can no longer evaporate when the anode rises to a high temperature during its operation and thus impair this operation. Thus, despite the brazing of the graphite, the working temperature is not limited by the temperature at which the brazing is done. It is further seen that, in these circumstances, the quantity of beryllium is not a critical factor.

Figure 4:
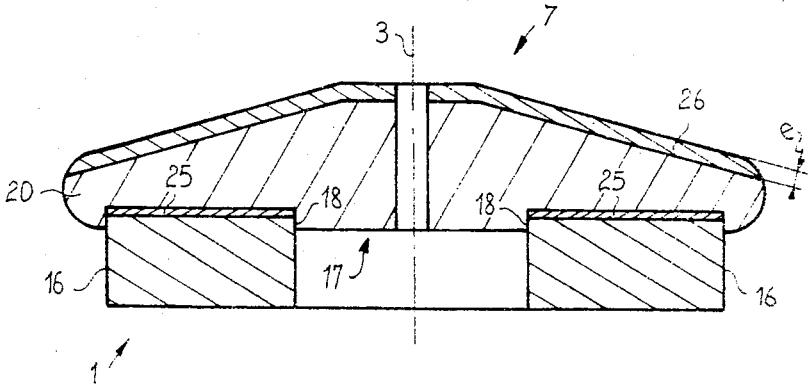
FIG. 4 is a schematic cross-section view of the anode according to the invention comprising a molybdenum body.

FIG. 4 depicts an embodiment of the anode according to the invention wherein the latter comprises a body 20 formed by a mass of molybdenum. In the non-exhaustive example described, the target material comprises a thick layer 26, made of tungsten for examle, which entirely covers the first surface 7. In the example described, the tungsten 6 has a relatively big thickness e and is joined, by a conventional thermal and mechanical process, to the molybdenum body 20 with which it forms a first part.

The rotating anode 1 further comprises a second part formed by a graphite ring 16 set on a second surface 17 of the body 20 made of molybdenum. The graphite ring 16 is centered on the axis of symmetry 3, in a second groove 18 machined in a second surface 17 of the body 20. The graphite ring 26 is brazed to the molybdenum of the body 2 by means of a fourth layer 25 of a bonding element. The bonding element comprises, as in the example of FIG. 3, a brazing element of a conventional type to which beryllium is added is such a way as to improve (as described earlier) the quality of the bond between the graphite and the molybdenum.

The present invention is applicable to any type of anode in which a graphite element is incorporated.

What is claimed is:

1. A rotating anode of the composite type, comprising:

a first part comprising at least one target material which is capable of producing X-ray radiation upon being subjected to an electron beam; and a second part made of graphite, said first and second parts being joined together by a bonding element comprising at least beryllium, wherein the bonding element enables the working temperature of said rotating anode to be increased.

2. The rotating anode of claim 1, wherein said bonding element comprises and intermediate material in combination with beryllium.

3. The rotating anode of claim 2, wherein the beryllium content of said bonding element ranges from 1–15% by wt. of the bonding element.

4. The rotating anode of claim 2, wherein said intermediate material is rhenium.

5. A rotating anode of the composite type, comprising:

a first part comprising at least a target material capable of producing X-ray radiation when subjected to an electron beam, said target being joined to a supporting body of molybdenum; and a second part formed of a ring of graphite joined to said supporting body by a bonding element, said bonding element comprising a brazing element to which beryllium is added.

* * * * *